United States Patent [19]

Tholander

[11] Patent Number: 4,541,462

[45] Date of Patent: Sep. 17, 1985

[54] WEFT YARN STORING, FEEDING AND MEASURING DEVICE, PREFERABLY FOR JET WEAVING MACHINES

[75] Inventor: Lars H. G. Tholander, Huskvarna, Sweden

[73] Assignee: Aktiebolaget IRO, Ulricehamn, Sweden

[21] Appl. No.: 641,899

[22] PCT Filed: Dec. 12, 1983

[86] PCT No.: PCT/SE83/00447

§ 371 Date: Aug. 8, 1984

§ 102(e) Date: Aug. 8, 1984

[87] PCT Pub. No.: WO84/02361

PCT Pub. Date: Jun. 21, 1984

[30] Foreign Application Priority Data

Dec. 10, 1982 [SE] Sweden ..... 8207098

[51] Int. Cl.[4] ..... D03D 47/36

[52] U.S. Cl. ..... 139/452; 242/47.01

[58] Field of Search ..... 139/452; 242/47.01, 242/47.12, 47.13

[56] References Cited

U.S. PATENT DOCUMENTS

| | | | |
|---|---|---|---|
| 3,776,480 | 12/1973 | Lawson | 242/47.01 |
| 3,853,153 | 12/1974 | Van Duynhoven | 139/452 |
| 4,407,336 | 10/1983 | Steiner | 139/452 |
| 4,415,008 | 11/1983 | Keller et al. | 139/370.2 |

FOREIGN PATENT DOCUMENTS

| | | | |
|---|---|---|---|
| 2908743 | 3/1978 | Fed. Rep. of Germany | 242/47.01 |
| 3043003 | 6/1981 | Fed. Rep. of Germany . | |
| 3123760 | 10/1983 | Fed. Rep. of Germany | 139/452 |
| 1562223 | 4/1969 | France . | |
| 2166332 | 8/1973 | France . | |
| WO82/04446 | 12/1982 | PCT Int'l Appl. . | |
| WO83/00121 | 5/1983 | PCT Int'l Appl. . | |
| 2065726 | 7/1981 | United Kingdom . | |

*Primary Examiner*—Henry S. Jaudon
*Assistant Examiner*—S. Shongut
*Attorney, Agent, or Firm*—Flynn, Thiel, Boutell & Tanis

[57] ABSTRACT

This device has a stationary storage durm (2) onto which an intermediate yarn store is wound by a winding-on device (3) and from which the yarn (WY) is withdrawn spiralling around the withdrawal end of the storage drum. The device also has a plurality of yarn stopping devices (10) being arranged at angular intervals around the storage drum, said yarn stopping devices consisting of yarn stopping elements (14) and of actuator means (11) moving said stopping elements into and out of the path of the yarn being withdrawn, and an actuator control device (8) adjustable to desired yarn lengths to be withdrawn, said control device transmitting actuating signals to said plurality of yarn stopping devices. The control device (8) comprises storing means (20) for storing an information regarding the yarn stopping device actuated at the end of the next preceding yarn withdrawal cycle, and calculating means (20) for determining a selected series sequence of said yarn stopping devices to be alternately actuated and de-actuated consecutively during the yarn withdrawal cycle on the basis of said stored information and of an adjustable input information for the calculating means representing at least one significant parameter for the distance/-time function of the weft yarn insertion process cycle. The calculating means (20) also determines the yarn stopping device to be kept actuated at the end of the present weft yarn withdrawal cycle at last one in said selected series sequence of alternately actuated and de-actuated yarn stopping devices, on the basis of said stored information and of an input information representing said desired yarn length.

13 Claims, 7 Drawing Figures

WY
1
2
4
5
7
8
10
11
12
13
14
15
16
17
18
$11_1$
$11_2$
$11_{24}$

WEFT YARN STORING, FEEDING AND MEASURING DEVICE, PREFERABLY FOR JET WEAVING MACHINES

The present invention relates to a weft yarn storing, feeding and measuring device, preferably for jet weaving machines, in accordance with the generic clause of claim 1.

DE-OS No. 31 23 760 (which corresponds to U.S. Pat. No. 4,407,336) discloses a yarn storing, feeding and measuring device for jet weaving machines having a stationary storage drum onto which an intermediate yarn store is wound by a winding-on device and from which the yarn is withdrawn spiralling around the withdrawal end of the storage drum, yarn sensing means being arranged such that the yarn is passing its detection area during withdrawal from the drum, said yarn sensing means producing pulse signals, each pulse signal indicating that the yarn passes a detection area of the yarn sensing means, a plurality of yarn stopping devices being arranged at angular intervals around the storage drum, said yarn stopping devices consisting of yarn stopping elements and actuator means moving said stopping elements into and out of the path of the yarn being withdrawn, and an actuator control device adjustable to desired weft yarn lengths to be withdrawn, said control device being responsive to said pulse signals in such a way that an actuating signal is transmitted to a yarn stopping device the angular position of which corresponds to the position rendered by the yarn when said desired yarn length has been withdrawn. The yarn sensing means consists of a plurality of yarn sensors, each of these sensors being associated with a yarn stopping device. Hence, the number of yarn sensors required for such a device corresponds to the number of yarn stopping devices. Yarn storing, feeding and measuring devices of this kind not only serve to intermediately store the weft yarn on a storage drum, but also serve to supply the jet weaving machine with a weft yarn length of a desired value. For the latter purpose, this known device carries out the following steps in order to obtain the desired yarn length for each weft yarn insertion into the shed of the weaving machine:

After releasing or de-actuating the yarn stopping device actuated at the end of a previous yarn withdrawal cycle, the yarn is withdrawn spiralling around the withdrawal end of the storage drum. Thereby, the yarn subsequently passes the detection area of each of the several yarn sensors being arranged at the withdrawal end of the storage drum in a spaced, angular relationship with respect to each other. Each yarn sensor generates a pulse signal indicating that the yarn passes its detection area, these pulse signals being fed to the control device. Hence, the control device receives a number of pulse signals, this number corresponding to the number of yarn sensors being passed by the yarn during the withdrawal from the storage drum. By counting these pulse signals received from the yarn sensors, the control device generates a count value corresponding to the actual position of the withdrawal point of the yarn with respect to the yarn sensors. The count value corresponds to the length of yarn having been withdrawn from the storage drum. When the count value corresponds to the desired yarn length to be withdrawn, the control device actuates the stopping device being located with respect to the angular movement of the withdrawal point of the yarn behind the yarn sensor which generated the last pulse signal. Thereby, the withdrawal of the yarn is stopped so that the desired yarn length is obtained. This known yarn storing, feeding and measuring device is costly and complicated due to the great number of yarn sensors required to achieve a sufficiently great number of different yarn lengths, or in other words to achieve a sufficiently great accuracy in the desired weft yarn length. A further drawback is caused by the fact that yarn sensors are also sensitive in operation, since they usually comprise optical elements which can be covered by lintor be disturbed by irrelevant light rays. If one of the several yarn sensors is e.g. covered by lint, it will no longer generate pulse signals when the yarn passes its detection area resulting in a wrong count value in the control device. Hence, the respective yarn length of the inserted weft yarn will become greater than the desired yarn length.

DE-OS No. 31 23 760 also discloses a yarn storing, feeding and measuring device using only one yarn sensor for detecting the withdrawal of one complete yarn winding from the storage drum. In order to be able to adjust the weft yarn length to be withdrawn, this prior art device makes use of a storage drum, the diameter of which can be mechanically varied. The same concept is disclosed in FR-A No. 2 166 332 and PCT-A WO 82/04446. A mechanical adjustment of the diameter of the storage drum, however, calls for complicated mechanical means, which makes the device costly and liable to malfunctions.

The object of the present invention is to provide a yarn storing, feeding and measuring device, which does not have said mechanical diameter adjustment means and is more reliable than the prior art devices as described above.

This object is achieved in accordance with the invention in that said control device comprises storing means for storing an information regarding the yarn stopping device actuated at the end of the next preceding yarn withdrawal cycle and calculating means for determining a selected series sequence of said yarn stopping devices to be alternately actuated and de-actuated consecutively during the yarn withdrawal cycle on the basis of said stored information and of an adjustable input information for the calculating means representing at least one significant parameter for the distance/time function of the weft yarn insertion process cycle, said calculating means also determining the yarn stopping device to be kept actuated at the end of the yarn withdrawal cycle as last one in said selected series sequence of actuated and de-actuated yarn stopping devices, on the basis of said stored information and of an input information representing the desired weft yarn length.

In a preferred embodiment of the present invention as claimed in claim 2, said significant parameter for the distance/time function of the weft yarn insertion process cycle is the desirable speed value for the weft yarn during said cycle. However, within the scope of the invention, it would also be possible to provide or set the calculating means of the control device with adjustable input information representing the desirable value of the deceleration of the weft yarn during the last phase of the weft insertion cycle, so as to achieve an optimally "soft" deceleration of the weft yarn. Analogously, it would also be possible to set the calculating means with adjustable input information representing the desirable value of the acceleration of the weft yarn during the initial phase of the weft insertion cycle.

A preferred embodiment of a yarn storing, feeding and measuring device in accordance with the present invention will now be described in detail with reference to the enclosed drawings, where FIG. 1 shows a side view of the yarn storing, feeding and measuring device in partially cut- and cross-sectional representation;

Figures 1, 2, 3, 4:
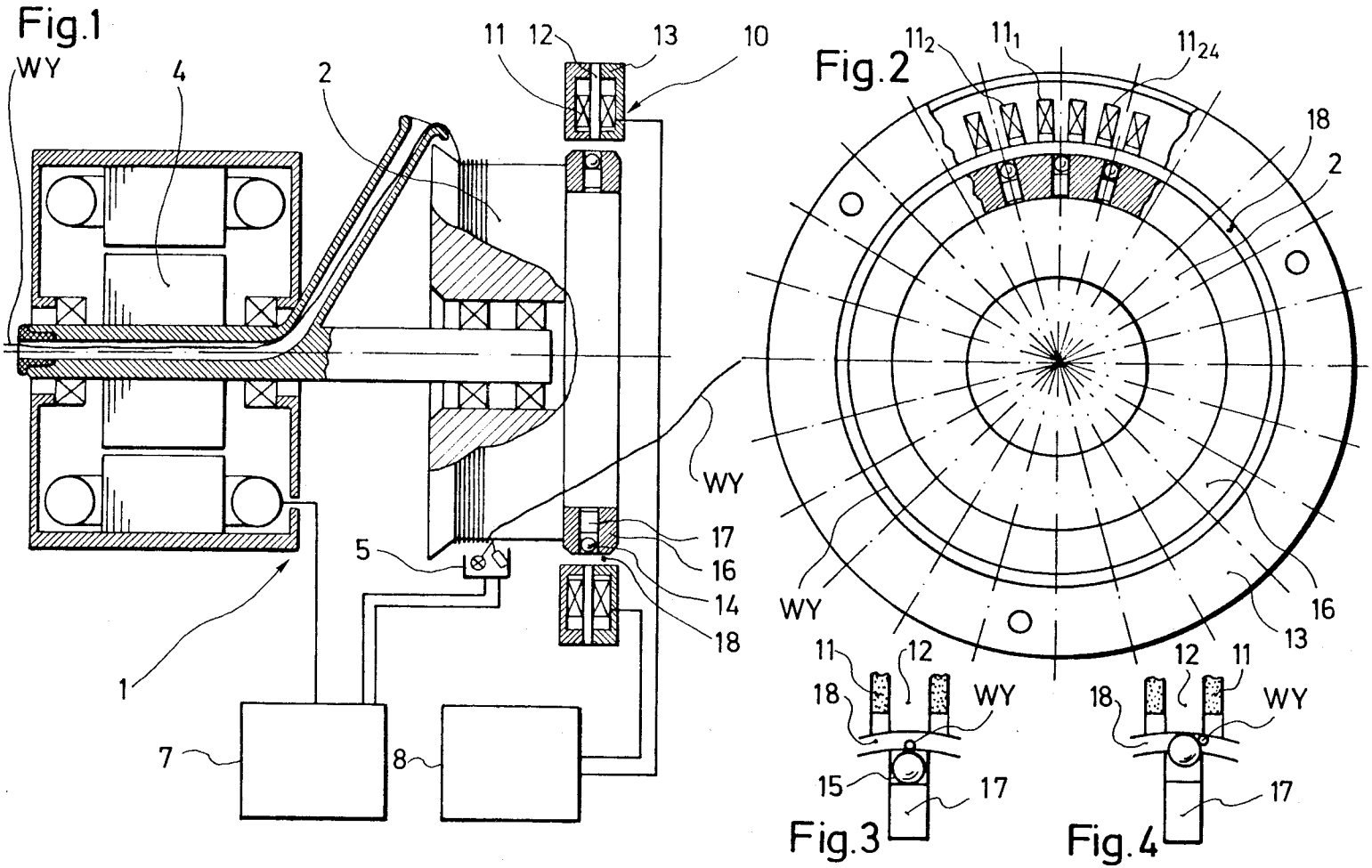
FIG. 2 shows a front view of the device as shown in FIG. 1.
FIGS. 3 and 4 show details of the device shown in FIG. 1 and 2.

Referring now to FIG. 1, a yarn storing, feeding and measuring device 1 consists of a storage drum 2, a winding-on device in the form of an orbiting feeder tube 3 and an electric motor 4 for driving this orbiting feeder tube. A weft yarn WY being supplied from a yarn spool (now shown here) to the orbiting feeder tube 3 driven by the motor 4 is wound onto the storage drum 2 and forms there an intermediate yarn store of several yarn windings. The storage drum 2 is here a stationary part being kept in stationary position with respect to the surroundings by magnetic means (not shown here). Devices of this type are well-known to the man skilled in the art, for example by U.S. Pat. No. 3,776,480 and by U.S. Pat. No. 3,853,153. The feeding device 1 is provided with a yarn store sensor 5, sensing the amount of yarn stored on the drum 2, which sensor is located close to the generally cylindrical surface of the storage drum 2. This store sensor 5 can be a so called maximum sensor preferably consisting of a light emitting device and a light receiving device. The yarn store sensor 5 generates a signal indicating the amount of yarn stored on the drum, i.e. in principle the number of windings of yarn stored on the drum. Based on this signal, a store control unit 7 controls the operation of the electric motor 4 in such a way that there is continuously a sufficient amount of yarn available on the yarn storage drum 2. Yarn store control units are per se well-known to the man skilled in the art. This art can be exemplified by DE-OS No. 29 08 743, FR-A No. 1 562 223 and U.S. Ser.No. 584,436 (Applicant's own).

A yarn stopping device 10 located at the withdrawal end of the storage drum 2 consists of an actuator means 11 comprising a plurality of electromagnetic coils 11 being wound around a coil core 12 supported of a balloon limiting ring 13 consisting of two U-shaped rings covering said plurality of electromagnetic coils 11. Said balloon limiting ring 13 is fixedly secured to the stationary part of the storing device 1, for example to a base plate thereof. A ring-shaped guiding portion 16 is connected to the withdrawal end of the storage drum 2. Said guiding portion 16 supports a plurality of yarn stopping elements 14, each of said yarn stopping elements 14 consisting of a metal ball 14 being movably disposed in a radial bore 15 provided in the guiding portion 16.

As shown in FIGS. 3 and 4, the respective electromagnetic coils 11 and associated cores 12 are arranged opposite to said bores 15. The balloon limiting ring 13 and the guiding portion 16 define a gap 18 being preferably in the order of 1–2 millimeters. The weft yarn WY passes said gap when being withdrawn from the storage drum 2. A permanent magnet 17 is located at one end of each bore 15 for moving back said metal ball 14 into said bore 15 after switching off an actuation current fed to the respective electromagnetic coils 11. As shown in FIGS. 3 and 4, the metal ball 14 is attracted by the magnetic force of the coil 11 when switching on the actuation current fed to the coil 11. The width of the gap 18 corresponds to the radius of the metal ball 14. When the coil 11 is not actuated, the permanent magnet 17 will attract the metal ball 14, so that the ball will be completely positioned inside the bore 15, whereby the yarn WY can be freely withdrawn in the axial direction from the storage drum 2 and inserted into the shed of the weaving machine.

The magnetic force of each electromagnetic coil 11 is chosen such that this force will overcome the attraction force of the permanent magnet 17 when feeding the actuation current to the coil 11. The metal ball 14 will thereby move outwardly in the radial direction of the bore 15 and come into contact with the free end of the coil core 12. In this state, approximately half the metal ball locks the gap 18 for the passage of the yarn WY in such a way that the withdrawal of the yarn from the storage drum 2 is prevented. When switching off the actuation current fed to the coil 11, the tension in the yarn WY, being pulled by the weft insertion means of the weaving machine, co-acts with the magnetic force of the permanent magnet 17 such that the metal ball 14 will return to its starting position so as to come into contact with the permanent magnet 17. As the tension of the yarn co-acts with the magnetic force of the magnet 17 due to the shape of the metal ball 14, the holding force of the permanent magnet 17 can be relatively small. Hence, only a small portion of the attracting force generated by the electromagnetic coil 11 is required for overcoming the magnetic force of the permanent magnet 17. For this reason, the yarn stopping device 10 is working faster than prior art devices using stopping elements 14 which are needle-shaped or pin-shaped. For further enhancing the operation of the yarn stopping device 10, a thin plate of non-magnetic material can be positioned at the outer end of the permanent magnet 17 and/or on the free end of the coil core 12 for eliminating a magnetic sticking or "adhesion" effect between the metal ball 14 and the permanent magnet 17 and/or the coil core 12.

The stopping element 14 can also have the form of a short cylindrical pin with a plane inner end directed to the permanent magnet 17 and a rounded, preferably semi-spherical outer end.

Figure 5:
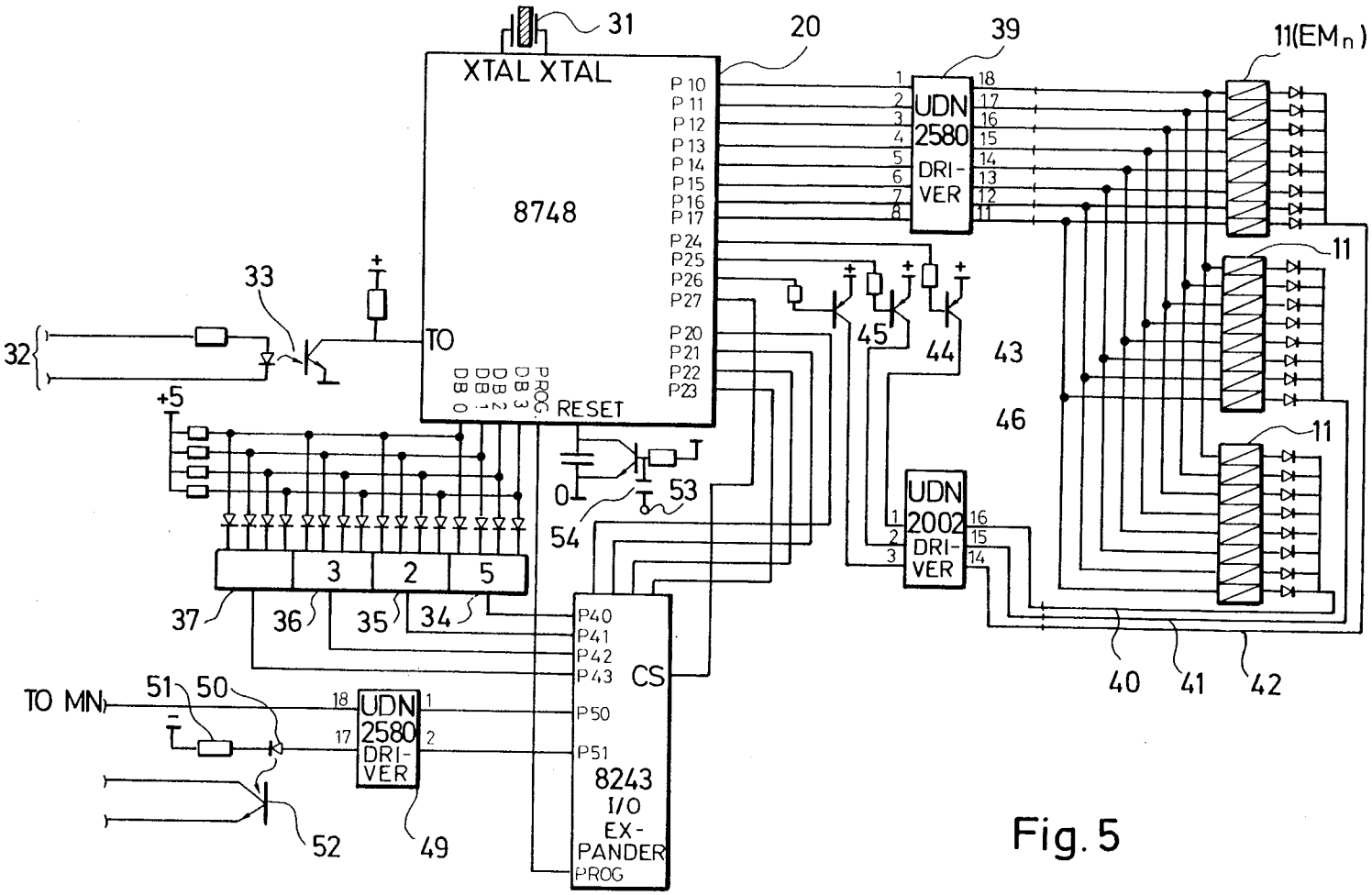
FIG. 5 shows a circuit diagram of the actuator control device of the measuring device shown in FIGS. 1–4.

Referring now to FIG. 5, the presently preferred embodiment of the actuator control device 8 will hereinafter be described in detail. This device 8 comprises a calculating means 20, which is a standard microprocessor, here of the type 8748, manufactured by the INTEL Corp., U.S.A.

The microprocessor 20 is supplied with sync signals generated by a crystal resonator 31 connected to input pins "XTAL" of the microprocessor.

A trigg-input 32 receives a signal picked up at the main shaft of the weaving machine. This signal is applied to the input of an opto-electronical coupling element 33, the output of which is connected to input pin TO of the microprocessor 20. The trigg-signal serves to synchronize the operation of the loom with the operation of the microprocessor 20 controlling the yarn storing, feeding and measuring device 1. More particularly, the occurrence of a trigg-signal on input 32 indicates that the next weft yarn insertion cycle starts.

In the actuator control device 8 there is provided, in accordance with the present invention, a combined weft yarn insertion speed/yarn length setting switching device, preferably consisting of three BCD-switches 34–36 and a Hexa-decimal code switch 37, each of these switches having four input terminals and one output terminal. Each of the BCD-switches can be set to a decimal number from 0–9, and the Hexa-decimal code switch from 0–F(=16). This decimal resp. hexa-decimal number is converted by the respective switch such that the corresponding one of its four input terminals is connected to its output terminal in accordance with the code. When for example setting one of the BCD-switches to the decimal number "5", then its first and third input terminal is connected to its output terminal, whereas its second and fourth input terminal is disconnected from the output terminal. The respective first input terminals of the switches 34–37 are connected via diodes to pin DB3 of the microprocessor 20, the respective second input terminals of the switches are connected via diodes to pin DB2 of the microprocessor, the respective third input terminals of the switches are connected via diodes to pin DB1 of the microprocessor and the respective fourth input terminals of the switches are consequently connected via diodes to pin DB0 of the microprocessor 20. The respective output terminals of the switches 34–37 are connected to output pins P40–P43 of an expansion circuit 38, here a standard circuit INTEL type 8243 ("I/O Expander"), the four input pins of which are designated P20–P23 and which are connected to pins also designated P20–P23 of the microprocessor 20. At the beginning, each of the pins DB0–DB3 of the microprocessor 20 is in its "high" state, i.e. logical one potential. The pins P20–P23 of the microprocessor 20 are also in the "high" state. For reading the value of one of the switches 34–37, the microprocessor 20 pulls down the voltage of one of its pins P20–P23. For example, for reading the BCD value of BCD-switch 34, the microprocessor 20 generates a certain, predetermined combination of "high" and "low" potential (logical one and zero) on the four pins P20–P23 and on its output pin called PROG, which is connected to the PROG input pin of the expansion circuit 38. The expansion circuit 38 will respond to said combination of "high" and "low" potential on its pin P20–P23 and PROG by generating a "low" potential (logical zero) on its output pin P40. In case the decimal number selected manually by the weaving machine operator on switch 34 is "5", the potential of pins DB3 and DB1 will be pulled down to "low", whereas the potential on pins DB2 and DB0 will remain "high". For reading one of the other switches, the microprocessor 20 generates another predetermined combination of "high" and "low" potential on its four pins P20–P23 and on its output pin PROG, whereby the expansion circuit 38 will generate "low" potential on another one of the pins P40–P43 leading to the switch to be read.

Output pins P10–P17 of the microprocessor 20 are connected to input pins 1–8 of an amplifier or driver circuit 39, this circuit having eight output pins 11–18, each of these being associated with a respective input pin 1–8. When receiving "high" potential (logical one) on one its input pins 1–8, the driver circuit 39 connects the corresponding output pin to a voltage source of −35 Volts. Each of the output pins 11–18 of the driver circuit 39 is connected to three electromagnetic coils 11. Twenty-four electromagnetic coils 11 associated with twenty-four yarn stopping devices 14 are arranged as a matrix having eight rows and three columns. The respective output terminals of the electromagnetic coils 11 arranged in one column are connected to a respective one of three output conductors 40–42.

Output pins P24–P26 of the microprocessor 20 are connected through current amplifier circuits 43–45 to input pins 1–3 of a further driver circuit 46. This driver circuit 46 includes three output pins 14–16, each being connected to a respective one of the conductors 40–42. When receiving a "high" potential (logical one) on one of its input pins, the driver circuit 46 connects the corresponding output pin to a voltage of +5 Volts. Due to the above described matrix circuit arrangement, the microprocessor 20 is enabled to energize one of the twenty-four electromagnetic coils 11 by generating a "high" potential on one the output pins P10–P17 determining the row of the coil 11 to be actuated, and by generating a "high" potential on one of its output pins P24–P26 selecting the column of the electromagnetic coil 11 to be actuated. The above described matrix circuit arrangement allows to actuate one electromagnetic coil 11 among the twenty-four electromagnetic coils 11 with only eleven output pins P10–P17 and P24–P26 of the microprocessor 20 and as many signal wires to the coils 11.

Output pin P51 of the expansion circuit 38 is connected via a current amplifier or driver circuit 49 to a light-emitting element 50, which in turn is connected to minus via a resistor 51. The light-emitting element 50 actuates an opto-sensitive switching element 52 actuating in turn a stop-motion relay (not shown here, but well-known to the man skilled in the art) of the weaving machine.

Output pin P50 of the expansion circuit 38 is connected via said driver circuit 49 to a relay of the valve for the main air jet nozzle (also well-known to the man skilled in the art) of the jet weaving machine. The driver circuits 39 and 49 are standard circuit elements of the type UDN 2580A. The further driver circuit 46 is also a standard circuit element of the type UDN 2002. The manufacturer of said standard circuit elements is the SPRAGUE Corp., U.S.A.

Figure 6:
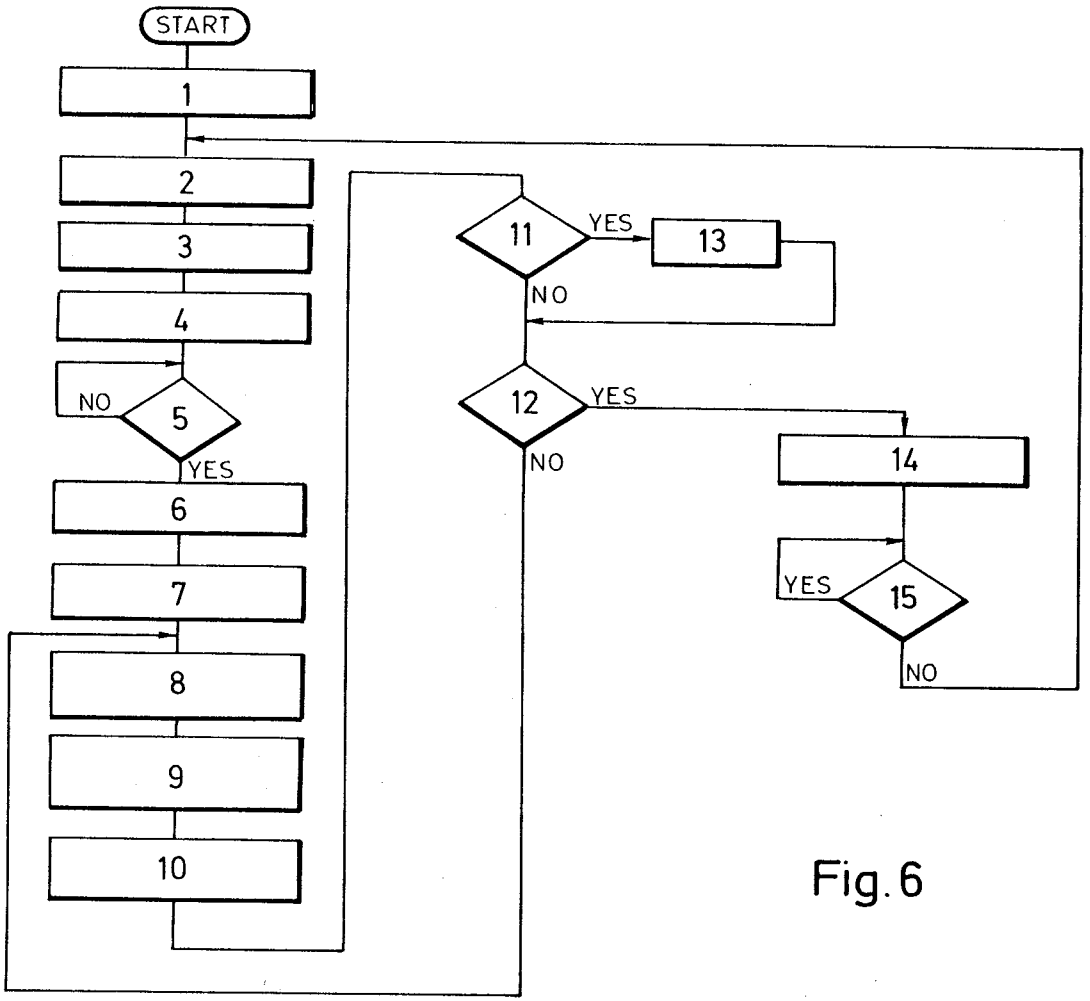
FIG. 6 shows a flow-diagram used in a microprocessor of the actuator control device as shown in FIG. 5.

Referring now to FIG. 6, there is shown a flow diagram of the control programme stored in the read-only memory of the presently preferred embodiment of the microprocessor 20. When receiving a reset signal, the microprocessor 20 is reset so as to start the carrying out of the progamme with the first instruction thereof, being the "START" instruction. This reset signal will be received on reset line 53 and will pass through a reset interface circuit 54 to the reset pin R of the microprocessor 20. The reset signal is automatically generated each time the main power of the weaving machine is switched on, which guarantees that the microprocessor begins to carry out the control programme with the START step after switching on the power of the weaving machine.

At programme step No. 1, the microprocessor 20 actuates a predetermined yarn stopping device 10 for locking the weft yarn WY is its start of withdrawal position. The microprocessor 20 stores the number of the actuated stopping device or its angular position in a predetermined storage cell of its RAM (Random Accessary Memory).

At programme step No. 2, the microprocessor 20 reads the hexa-decimal code of the switch 37 representing a desired, manually set value of the weft yarn insertion speed, and stores this value in a storage cell of its RAM. At programme step No. 3, the microprocessor 20 consecutively reads the BCD code of the switches representing the desired, manuall set weft yarn length and stores this length value is another storage cell of the RAM of the microprocessor. At programme step No. 4, the microprocessor 20 transfers the BCD codes representing the set desired weft yarn length to a digital value corresponding to the number of withdrawal revolutions and 1/24 revolutions of the storage drum 2, whereby this digital value represents the number of revolutions around the storage drum which the withdrawal point of the yarn travels during one weft yarn insertion cycle, i.e. during withdrawal of the desired, set weft yarn length. On the basis of said digital number, the microprocessor 20 determines which yarn stopping device shall be actuated by the end of the present weft yarn withdrawal (and insertion) cycle. The number of the determined stopping device is stored in a predetermined storage cell of the RAM of the microprocessor.

At programme step No. 5, there is a waiting routine, causing the microprocessor 20 to await the receipt of a trigg-signal from the weaving machine, e.g. in the form of a signal representing the actual position of the main shaft of the weaving machine at the moment when the present weft yarn insertion cycle shall start. This trigg-signal can be generated by a rotary sensor, per se well-known to the man skilled in the art, reading the angular position of the main shaft of the weaving machine. This waiting routine is realized by a programme loop periodically checking whether said trigg-signal occurs. If this condition is fulfilled, the microprocessor 20 continues to programme step No. 6.

At programme step No. 6, the microprocessor 20 generates, by generating a predetermined combination of "high" and "low" potential on its output pins P20–P23 and PROG, a "high" potential on output P50 of the expansion circuit 38, whereby the main air jet nozzle of the weaving machine will be opened. At programme step No. 7, the yarn stopping device 10 actuated during programme step No. 1 is de-actuated for releasing the locked weft yarn for withdrawal from the storage drum 2. From this moment the weft yarn will be pulled by the opened main air jet nozzle and withdrawn from the drum 2, whereby the withdrawal point will travel around the circumference or periphery of the withdrawal end of the drum 2.

In this presently preferred embodiment of the invention, as soon as the microprocessor 20 has carried out programme step No. 7, the microprocessor will, in programme step No. 8, actuate the yarn stopping device in the position next before the stopping device that was de-actuated in programme step No. 7. For example, if there are twenty-four yarn stopping devices $EM_1$--$EM_{24}$ around the drum 2 and stopping device $EM_8$ was actuated in programme step No. 1 and de-actuated in programme step No. 7, yarn stopping device $EM_7$ will be actuated in programme step No. 8.

Programme step No. 9 involves a time delay which varies in dependence on the set desired weft yarn insertion speed on code switch 37. After this time delay, the microprocessor 20 continues to programme step No. 10, in which the yarn stopping device as actuated in programme step No. 8 will be de-actuated again, so as to allow the yarn to pass this stopping device during its continued withdrawal from the drum. However, this means that the weft yarn cannot pass stopping device $EM_7$ before a point of time determined by the set weft yarn speed, that is a kind of continuous control of the yarn withdrawal has been achieved.

At programme step No. 11, the microprocessor 20 examines the condition whether the point of time for switching off the valve of the main air jet nozzle has been reached, which point of time has been calculated by the microprocessor on the basis of the point of time for switching on the main nozzle, the set weft yarn length and the set weft yarn speed. If this condition is not fulfilled, the microprocessor continues with programme step No. 12, in which the microprocessor examines whether the point of time for actuating the yarn stopping device determined in programme step No. 4 has been reached.

If the condition at programme step No. 11 is fulfilled, the microprocessor goes to step No. 13, in which it switches off the main air jet nozzle, before it continues to step No. 12.

If the condition in programme step No. 12 is not fulfilled, the microprocessor 20 goes back to programme step No. 8, in which it now actuates the yarn stopping device in the position next before the stopping device that was de-actuated in programme step No. 10, that is in this case stopping device $EM_6$. The microprocessor 20 then continues to go through the loop consisting of programme steps No. 9, 10, 11, 12 and back to No. 8, until the condition is step No. 12 is fulfilled, that is until the point of time for actuating the yarn stopping device determined in programme step No. 4 has been reached.

When the condition at programme step No. 12 has been fulfilled, the microprocessor 20 continues with step No. 14, in which the yarn stopping device as determined during programme step No. 4 is actuated for finally stopping the yarn withdrawal at the end of the weft yarn insertion cycle.

Then, in programme step No. 15, the microprocessor 20 examines whether there is still an occurring trigg-signal from the weaving machine. If this signal has meanwhile disappeared, the microprocessor goes back to programme step No. 2 again and all the programme steps for carrying out a new weft yarn insertion cycle (withdrawal cycle) are repeated again.

From the description above one can see that by actuating and de-actuating certain predetermined ones of the yarn stopping devices around the drum, the de-actuating being carried out at calculated points of time as determined by the set weft yarn length, it has become possible to keep a reliable control over the whole yarn withdrawal cycle, since the yarn will be permitted to pass the predetermined stopping devices only when said calculated points of time are respectively reached.

The present invention is not limited to the embodiment described above but several other embodiments are possible within the scope of the invention, particularly with regard to the selected sequence of yarn stopping devices to be consecutively actuated and de-actuated during the yarn withdrawal cycle.

Figure 7:
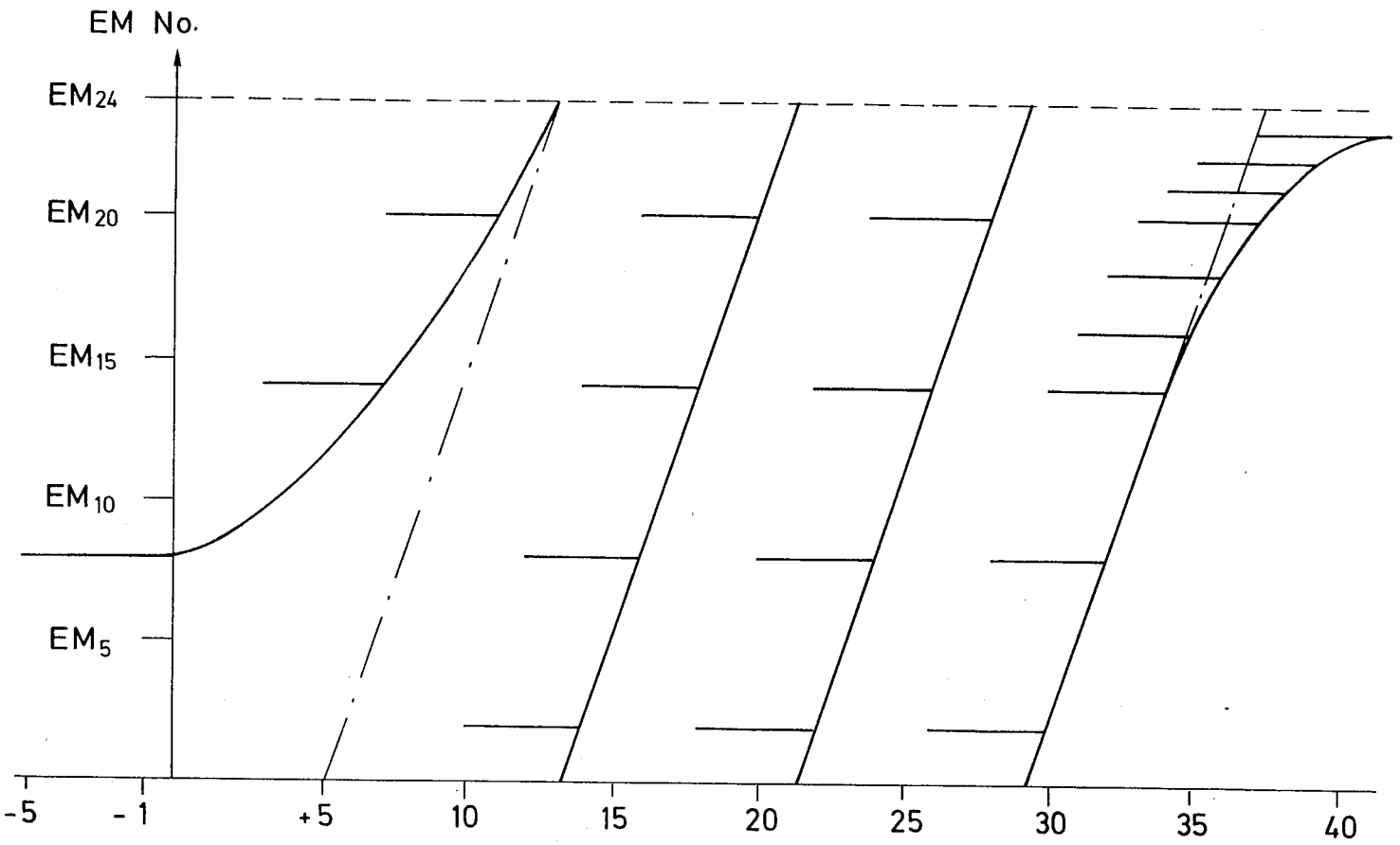
FIG. 7 shows a schematic diagram of a sequence control according to the present invention, where the calculating means of the actuator control device is set with information regarding desirable values of acceleration, maximum speed as well as deceleration of the weft yarn during the whole weft insertion cycle.

For example, FIG. 7 shows a schematic diagram of a more advanced sequence control of the yarn stopping devices in accordance with the present invention, where the actuator control device has been set with information of desirable values of not only weft yarn speed, but also of acceleration as well as deceleration for the weft yarn. In this advanced embodiment, which however make great demands on very short response times for the stopping devices, the microprocessor de-actuates electromagnet or stopping device $EM_8$ at a point of time t=0, whereby the weft yarn starts to be withdrawn from the storage drum 2 of the yarn storing, feeding and measuring device 1. During the acceleration phase, the microprocessor actuates stopping device $EM_{14}$ at t=3 ms (milli-seconds), respectively de-actuates same at t=7 ms, whereby the yarn not until the latter moment t=7 ms is permitted to pass the stopping device, which means that the yarn withdrawal during this phase will be adapted to the desired, set acceleration curve characteristics. For this embodiment of the invention, the setting of desired value of acceleration calls for an additional code switch, preferably of the hexa-decimal type.

At the end of its acceleration phase the weft yarn is permitted to pass the stopping device $EM_{20}$ at point of time t=11 ms by de-actuating said stopping device at this point of time after having been actuated at t=7 ms. The weft yarn insertion cycle now enters the phase in which the speed of the yarn is at the maximum and essentially constant, during which phase the yarn is allowed to pass by turn the stopping devices $EM_2$, $EM_8$ (whereby the yarn withdrawal point has travelled one revolution around the drum 2), then $EM_{14}$, $EM_{20}$, $EM_2$, $EM_8$ (whereby the yarn withdrawal point has travelled two revolutions around the drum), then $EM_{14}$, $EM_{20}$, $EM_2$, $EM_8$ (=three revolutions around the drum) and finally stopping device $EM_{14}$, that is every sixth stopping device is de-actuated (after respective actuation) in this phase at the following respective points of time: t=14 ms, 16 ms, 18 ms, 20 ms, 22 ms, 24 ms, 26 ms, 28 ms, 30 ms, 32 ms and finally t=34 ms.

Now, the weft yarn insertion cycle enters its last phase, in which the yarn shall be retarded in an optimally "soft" way, in this embodiment by de-actuating (after respective actuation) by turn the yarn stopping devices $EM_{16}$, $EM_{18}$, $EM_{20}$, $EM_{21}$ and $EM_{22}$ at points of time t=35 ms, 36 ms, 37 ms, 38 ms respectively at t=39 ms. Setting of a desired deceleration value also calls for an additional code switch. On the basis of the set desired weft yarn length, in this case 3 15/24×the circumference of the drum, the microprocessor of the actuator control device has selected (also on the basis that $EM_8$ was the actuated stopping device at the end of the next preceding insertion cycle) that stopping device $EM_{23}$ shall be actuated for stopping the yarn withdrawal during the present insertion cycle. Therefore, this stopping device is actuated at point of time t=37 ms and is not de-actuated again until the microprocessor has received a new trigg-signal from the weaving machine telling that a new insertion cycle shall start.

1 "ACTUATE STOPPING DEVICE FOR LOCKING YARN IN ITS START POSITION; STORE NUMBER OF SAID STOPPING DEVICE"
2 "READ THE CODE SWITCH FOR SET WEFT YARN SPEED; STORE THE SET VALUE"
3 "READ THE CODE SWITCHES FOR SET WEFT YARN LENGTH; STORE THE SET VALUE"
4 "TRANSFER SET WEFT YARN LENGTH TO WITHDRAWAL REVOLUTIONS AND 1/24 REVOLUTIONS; CALCULATE WHICH STOPPING DEVICE TO BE ACTUATED NEXT BY END OF WITHDRAWAL CYCLE; STORE ITS NUMBER"
5 "TRIG SIGNAL FROM WEAVING MACHINE?"
6 "ACTUATE SOLENOID VALVE FOR MAIN NOZZLE"
7 "RELEASE YARN BY DE-ACTUATING DRAWN STOPPING DEVICE"
8 "ACTUATE STOPPING DEVICE IN POSITION NEXT BEFORE JUST DE-ACTUATED STOPPING DEVICE"
9 "TIME DELAY DETERMINED BY THE SET WEFT YARN SPEED VALUE"
10 "DE-ACTUATE DRAWN STOPPING DEVICE IN STEP (7)"
11 "TIME TO CLOSE MAIN NOZZLE?"
12 "TIME TO ACTUATE "LAST" STOPPING DEVICE?"
13 "CLOSE THE MAIN NOZZLE"
14 "ACTUATE THE STOPPING DEVICE DETERMINED AT STEP (4)"
15 "TRIG SIGNAL FROM WEAVING MACHINE?"

I claim:

1. Yarn storing, feeding and measuring device, particularly for jet weaving machines, having a stationary storage drum (2) onto which an intermediate yarn store is wound by a winding-on device (3) and from which the yarn (WY) is withdrawn spiralling around the withdrawal end of the storage drum, a plurality of yarn stopping devices (10) being arranged at angular intervals around the storage drum, said yarn stopping devices consisting of yarn stopping elements (14) and of actuator means (11) moving said stopping elements into and out of the path of the yarn being withdrawn, and an actuator control device (8) adjustable to desired yarn lengths to be withdrawn, said control device transmitting actuating signals to said plurality of yarn stopping devices, characterized in that said control device (8) comprises storing means (20) for storing an information regarding the yarn stopping device actuated at the end of the next preceding yarn withdrawal cycle and calculating means (20) for determining a selected series sequence of said yarn stopping devices to be alternately actuated and de-actuated consecutively during the yarn withdrawal cycle on the basis of said stored information and of an adjustable input information for the calculating means representing at least one significant parameter for the distance/time function of the weft yarn insertion process cycle, said calculating means (20) also determining the yarn stopping device to be kept actuated at the end of the present weft yarn withdrawal cycle as last one in said selected series sequence of alternately actuated and de-actuated yarn stopping devices, on the basis of said stored information and of an input information representing said desired yarn length.

2. Device as claimed in claim 1, characterized in that said significant parameter for the distance/time function of the weft yarn insertion process cycle is the speed of the weft yarn (WY) during said cycle, and in that said selected series sequence of yarn stopping devices (14) is de-actuated at points of time determined by the set desired value of the weft yarn speed.

3. Device as claimed in claims 1 or 2, characterized in that said storing and calculating means (20) consists of a microprocessor.

4. A yarn storing, feeding and measuring device, particularly for jet weaving machines, having a stationary storage drum onto which an intermediate yarn store is wound by a winding-on device and from which the yarn is withdrawn spiralling around the withdrawal end of the storage drum, a plurality of yarn stopping devices being arranged at angular intervals around the storage drum, and a control device transmitting actuating signals to said plurality of yarn stopping devices, wherein said control device comprises storing means for storing information regarding the yarn stopping device actuated at the end of the last yarn withdrawal cycle, and calculating means for determining, on the basis of said stored information, a series sequence of yarn stopping devices to be alternately actuated and de-actuated during said yarn withdrawal cycle, and for determining, on the basis of said stored information, the yarn stopping device to be kept actuated at the end of the present weft yarn withdrawal cycle.

5. A yarn storing, feeding and measuring device as claimed in claim 4, wherein said control device comprises a first input section for inputting information concerning the desired yarn length to be withdrawn from the storage drum during each yarn withdrawal cycle.

6. A yarn storing, feeding and measuring device as claimed in claim 5, wherein said control device comprises a second input section for inputting information concerning the yarn withdrawal speed.

7. A yarn storing, feeding and measuring device as claimed in claim 5, wherein said calculating means determines, on the basis of stored information and on the basis of said information concerning the desired yarn length, said yarn storing device to be kept actuated at the end of the present weft yarn withdrawal cycle.

8. A yarn storing, feeding and measuring device as claimed in claim 6, wherein said calculating means determines, on the basis of said information concerning the yarn withdrawal speed, a period of time during which a yarn stopping device among the series sequence of yarn storing devices remains actuated.

9. Method for controlling a yarn storing, feeding and measuring device, particularly for jet weaving machines, having a stationary storage drum onto which an intermediate yarn store is wound by a winding-on device and from which the yarn is withdrawn spiralling around the withdrawal end of the storage drum and a plurality of yarn stopping devices being arranged at angular intervals around the storage drum, wherein the yarn stopping devices are alternately actuated and de-actuated for controlling the withdrawal of yarn from the drum, and that the yarn withdrawal speed is defined by the period of time during which a yarn stopping device remains actuated and by the angular distance between two yarn stopping devices subsequently actuated during a weft yarn withdrawal cycle.

10. Method as claimed in claim 9, including the step of storing information concerning the yarn stopping device actuated at the end of the last yarn withdrawal cycle.

11. Method as claimed in claim 10, including the step of calculating the stopping device to be actuated at the end of the present withdrawal cycle on the basis of said stored information concerning the yarn stopping device actuated at the end of the last yarn withdrawal cycle and on the basis of an input information representing the weft yarn withdrawal length.

12. Method as claimed in claim 9, including the step of determining a period of time during which a yarn stopping device remains actuated, on the basis of an input information concerning the weft yarn withdrawal speed.

13. Method as claimed in claim 9, wherein the respective angular distances between two subsequently actuated yarn stopping devices and/or the respective periods of time during which the yarn stopping devices are actuated are chosen such that the weft yarn withdrawal speed increases at the beginning of a weft yarn withdrawal cycle, the withdrawal speed remains constant during a subsequent part of the weft yarn withdrawal cycle, and the weft yarn withdrawal speed is reduced at the end of the weft yarn withdrawal cycle by varying the respective periods of time during which the yarn stopping devices remain actuated and/or by varying the respective angular distances between two subsequently actuated yarn stopping devices.

* * * * *

UNITED STATES PATENT AND TRADEMARK OFFICE

CERTIFICATE OF CORRECTION

PATENT NO. : 4 541 462

DATED : September 17, 1985

INVENTOR(S) : Lars H. G. THOLANDER

It is certified that error appears in the above-identified patent and that said Letters Patent is hereby corrected as shown below:

Column 11, line 1; change "claims 1 or 2" to ---claim 1---.

Signed and Sealed this

Twenty-fifth Day of November, 1986

*Attest:*

DONALD J. QUIGG

*Attesting Officer* *Commissioner of Patents and Trademarks*